US010287788B2

(12) United States Patent
Kwong

(10) Patent No.: US 10,287,788 B2
(45) Date of Patent: May 14, 2019

(54) MOBILE HOUSE OF AN ALUMINUM ALLOY STRUCTURE

(71) Applicant: AluHouse Technology (GD) Company Limited, Guangdong (CN)

(72) Inventor: Hoi Fung Kwong, Guangdong (CN)

(73) Assignee: AluHouse Technology (GD) Company Limited, Guangdong (CN)

( * ) Notice: Subject to any disclaimer, the term of this patent is extended or adjusted under 35 U.S.C. 154(b) by 0 days.

(21) Appl. No.: 16/019,700

(22) Filed: Jun. 27, 2018

(65) Prior Publication Data

US 2019/0106895 A1 Apr. 11, 2019

(30) Foreign Application Priority Data

Oct. 11, 2017 (CN) ..... 2017 1 0941326

(51) Int. Cl.
*E04H 1/02* (2006.01)
*E04B 1/34* (2006.01)
*E04B 1/343* (2006.01)

(52) U.S. Cl.
CPC ..... *E04H 1/02* (2013.01); *E04B 1/34336* (2013.01)

(58) Field of Classification Search
CPC ..... E04H 1/02; E04B 1/34336
See application file for complete search history.

(56) References Cited

U.S. PATENT DOCUMENTS 3,301,147 A * 1/1967 Clayton ..... E01C 9/083 404/35
3,385,182 A * 5/1968 Harvey ..... E01C 9/083 404/35
3,984,961 A * 10/1976 Chieger ..... B65D 90/026 52/592.1
5,204,149 A * 4/1993 Phenicie ..... B65D 90/026 220/1.5
5,311,718 A * 5/1994 Trousilek ..... E04B 2/8629 52/421
6,250,022 B1 * 6/2001 Paz ..... E04B 1/34321 312/100

(Continued)

FOREIGN PATENT DOCUMENTS

CN 203866959 U * 10/2014
DE 29708243 U1 * 10/1997 ..... B66B 11/00

(Continued)

*Primary Examiner* — Jeanette E Chapman
(74) *Attorney, Agent, or Firm* — Alan D. Kamrath; Kamrath IP Lawfirm, P.A.

(57) ABSTRACT

A mobile house of an aluminum alloy structure includes a C-shaped frame having a bottom frame, a side frame, and a top frame. Floor panels are mounted on the bottom frame, wallboards are mounted on the side frame, and roof panels are mounted on the top frame. A lower arm of a lower arm inner buckle of each floor panel is fixed to an end ledge of an adjacent floor panel by a respective fastener. The roof panels and the floor panels have an identical structure. A lower arm of a lower arm inner buckle of each wallboard is fixed to an end ledge of an adjacent wallboard by a respective fastener. Upper arcuate wallboards are mounted between the innermost roof panel and the uppermost wallboard. Lower arcuate wallboards are mounted between the innermost floor panel and the lowest wallboard.

9 Claims, 6 Drawing Sheets

(56) References Cited

U.S. PATENT DOCUMENTS

| | | | | |
|---|---|---|---|---|
| 6,324,796 | B1 * | 12/2001 | Heath | E04B 5/026 52/177 |
| 7,596,924 | B2 * | 10/2009 | Sakae | B62D 25/06 296/155 |
| 7,665,651 | B2 * | 2/2010 | Aota | B23K 20/122 228/112.1 |
| 9,631,358 | B1 * | 4/2017 | Trahan | E04B 1/34321 |
| 10,011,979 | B1 * | 7/2018 | Kwong | E04B 1/08 |
| 10,196,807 | B2 * | 2/2019 | Kwong | E04B 1/3205 |
| 2009/0223153 | A1 * | 9/2009 | MacGregor | E04B 1/3483 52/284 |
| 2009/0266005 | A1 * | 10/2009 | Snel | E04B 1/34321 52/79.1 |
| 2011/0067321 | A1 * | 3/2011 | Hijazi | E04B 1/3205 52/79.1 |
| 2012/0255240 | A1 * | 10/2012 | Shen | E04B 1/34305 52/79.5 |
| 2015/0152636 | A1 * | 6/2015 | Connell | E04H 1/1261 52/79.1 |
| 2016/0319534 | A1 * | 11/2016 | Bernardo | E04B 1/3483 |

FOREIGN PATENT DOCUMENTS

| | | | | |
|---|---|---|---|---|
| FR | 2721962 | A1 * | 1/1996 | E04B 1/10 |
| JP | 01312168 | A * | 12/1989 | |

* cited by examiner

MOBILE HOUSE OF AN ALUMINUM ALLOY STRUCTURE

BACKGROUND OF THE INVENTION

The present invention relates to the field of an architecture structure and, more particularly, to a mobile house of an aluminum alloy structure and its whole system structure.

It is always desirable to include a movable space without a vertical structure in architectural designs, such that flexible configurations can be proceeded according to needs, providing versatile indoor arrangements.

Most of currently available mobile houses are made of steel structures and have main shortcomings including heavy weights, using materials not resistant to corrosion, and short service lives.

In view of the above drawbacks, persons skilled in the field dedicated to the development of a mobile house of an aluminum alloy structure whose components can be manufactured in a factory and then transported to the site for proceeding with module-type assembly.

BRIEF SUMMARY OF THE INVENTION

An objective of the present invention is to provide a mobile house of an aluminum alloy structure which is produced from aluminum alloy extrusions through precision manufacturing. The aluminum alloy wall boards, aluminum alloy roof panels, aluminum alloy floor panels, and aluminum alloy arcuate wallboards are connected to each other and assembled plus fixing by nails or screws to provide a reliable, safe connection for the structure, assuring that the whole structure is enhanced in the bending strength, the torsional strength, the impact resistance, the impermeability to water, and the overall stability. Thus, the spatial utility of the house is increased, and the appearance of the house is more aesthetic.

A mobile house of an aluminum alloy structure according to the present invention includes a plurality of components made of an aluminum alloy. The plurality of components includes a C-shaped frame, an upper beam, a lower beam, a plurality of roof panels, a plurality of floor panels, a plurality of wallboards, a plurality of upper arcuate wallboards, and a plurality of lower arcuate wallboards. The plurality of components is connected by a plurality of fasteners.

The C-shaped frame includes a bottom frame, a side frame, and a top frame. The plurality of floor panels is mounted on the bottom frame. The plurality of wallboards is mounted on the side frame. The plurality of roof panels is mounted on the top frame. The plurality of upper arcuate wallboards is mounted between the top frame and the side frame. The plurality of lower arcuate wallboards is mounted between the side frame and the bottom frame.

The upper beam is mounted on an end of the top frame of the C-shaped frame. The lower beam is mounted on an end of the bottom frame of the C-shaped frame.

Each of the plurality of floor panels includes an end having an upper, inner buckle and a lower arm inner buckle. Each of plurality of floor panels includes another end having an upwardly-inclined outer buckle and a lower, outer buckle. Each of the upper, inner buckle and the upwardly-inclined outer buckle of each of the plurality of floor panels has a coupling portion extending outward. The coupling portion of the upper, inner buckle of each of the plurality of floor panels is coupled with the coupling portion of the upwardly-inclined outer buckle of an adjacent floor panel. The lower arm inner buckle of each of the plurality of floor panels includes a lower arm having an inner ridge coupled with the lower, outer buckle of the adjacent floor panel. The lower arm of the lower arm inner buckle of each of the plurality of floor panels is fixed to an end ledge of the adjacent floor panel by a respective one of the plurality of fasteners.

A structure of each of the plurality of roof panels is identical to a structure of each of the plurality of floor panels.

Each of the plurality of wallboards includes an end having an upper, inner buckle and a lower arm inner buckle. Each of the plurality of wallboards further includes another end having an upper, outer buckle and a lower, outer buckle. Each of the upper, inner buckle and the upper, outer buckle of each of the plurality of wallboards has a coupling portion extending outward. The coupling portion of the upper, inner buckle of each of the plurality of wallboards is coupled with the coupling portion of the upper, outer buckle of an adjacent wallboard. The lower arm inner buckle of each of the plurality of wallboards includes a lower arm having an inner ridge coupled with the lower, outer buckle of the adjacent wallboard. The lower arm of the lower arm inner buckle of each of the plurality of wallboards is fixed to an end ledge of the adjacent wallboard by a respective one of the plurality of fasteners.

Each of the plurality of upper and lower arcuate wallboards has an arcuate inner face and an arcuate outer face. Each of the plurality of upper and lower arcuate wallboards includes an end having an upper, inner buckle and a lower arm inner buckle. Each of the plurality of upper and lower wallboards further includes another end having an upper, outer buckle and a lower, outer buckle. Each of the upper, inner buckle and the upper outer buckle of each of the plurality of upper and lower arcuate wallboards has a coupling portion extending outward.

Two adjacent upper arcuate wallboards are coupled with each other by the coupling portion of the upper, inner buckle of one of the two adjacent upper arcuate wallboards and the coupling portion of the upper, outer buckle of another of the two adjacent upper arcuate wallboards.

Two adjacent lower arcuate wallboards are coupled with each other by the coupling portion of the upper, inner buckle of one of the two adjacent lower arcuate wallboards and the coupling portion of the upper, outer buckle of another of the two adjacent lower arcuate wallboards.

The end or the another end of an innermost one of the plurality of floor panels mounted to the lower frame of the C-shaped frame is coupled with a lowest one of the plurality of lower arcuate wallboards.

The end or the another end of a lowest one of the plurality of wallboards is coupled with an uppermost one of the plurality of lower arcuate wallboards.

The end or the another end of an uppermost one of the plurality of wallboards is coupled with a lowest one of the plurality of upper arcuate wallboards.

The end or the another end of an innermost one of the plurality of roof panels mounted to the upper frame of the C-shaped frame is coupled with an uppermost one of the plurality of upper arcuate wallboards.

In an example, a lamp groove is mounted in an outer end of the lower beam mounted to the end of the bottom frame of the C-shaped frame and includes an upper section and a lower section. Each of the upper section and the lower section of the lamp groove receives a lamp string. A waterproof board is mounted to a bottom of the lamp groove. The lamp groove further includes an outer section, and a light-permeable decorative panel is mounted in the outer section of the lamp groove.

In an example, a lamp groove is mounted in an outer end of the upper beam mounted to the end of the top frame of the C-shaped frame and includes an upper section and a lower section. Each of the upper section and the lower section of the lamp groove receives a lamp string. A waterproof board is mounted to a top of the lamp groove. A waterproof sealing material is mounted between the upper beam, the waterproof board, and the end of the top frame of the C-shape frame. The lamp groove further includes an outer section, and a light-permeable decorative panel is mounted in the outer section of the lamp groove.

In an example, each of the plurality of floor panels, the plurality of roof panels, the plurality of wallboards, the plurality of upper arcuate wallboards), and the plurality of lower arcuate wallboards includes an inner face having a C-shaped groove configured to receive a bolt.

In an example, each of the plurality of floor panels, the plurality of roof panels, the plurality of wallboards, the plurality of upper arcuate wallboards, and the plurality of lower arcuate wallboards includes a plurality of reinforcing ribs therein.

In an example, each of the plurality of fasteners is a screw or a pin.

The mobile house of an aluminum alloy structure according to the present invention including the roof, wallboards, and ground connecting system is produced from aluminum alloy extrusions through precision manufacturing. The aluminum alloy wall boards, aluminum alloy roof panels, aluminum alloy floor panels, and aluminum alloy arcuate wallboards are connected to each other and assembled plus fixing by nails or screws to provide a reliable, safe connection for the components, assuring that the whole structure is enhanced in the bending strength, the torsional strength, the impact resistance, the impermeability to water, and the overall stability. Thus, the spatial utility of the house is increased, and the appearance of the house is more aesthetic.

The mobile house of an aluminum alloy structure according to the present invention includes the following features: 1. The unique structures of the wallboards, the roof panels, the floor panels, the upper and lower arcuate wallboards. 2. Excellent waterproof property. 3. Aesthetic and fashion appearance. 4. Easy installation. 5. Modularized production. 6. Transportation of the whole assembly. 7. Low use costs. 8. Eco-friendly low carbon emission.

The present invention will become clearer in light of the following detailed description of illustrative embodiments of this invention described in connection with the drawings.

DETAILED DESCRIPTION OF THE INVENTION

Figure 1:
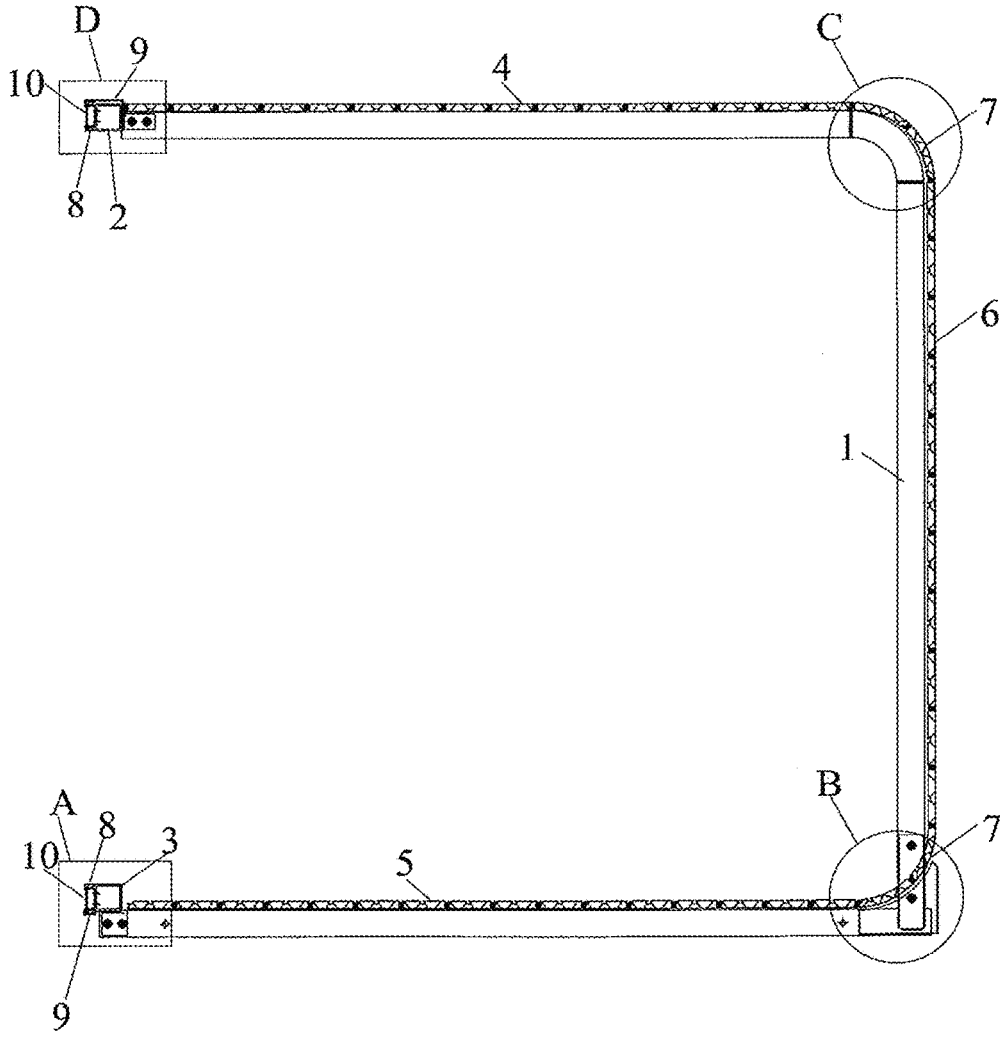
FIG. 1 is a cross sectional view of a mobile house of an aluminum alloy structure according to the present invention.

Referring to FIGS. 1-5 and 10, a mobile house of an aluminum alloy structure according to the present invention includes a plurality of components made of an aluminum alloy. The plurality of components includes a C-shaped frame 1, an upper beam 2, a lower beam 3, a plurality of roof panels 4, a plurality of floor panels 5, a plurality of wallboards 6, a plurality of upper arcuate wallboards 7, and a plurality of lower arcuate wallboards 7. The plurality of components is connected by a plurality of fasteners 12.

The C-shaped frame 1 includes a bottom frame, a side frame, and a top frame. Thus, the whole aluminum frame is substantially C-shaped. The plurality of floor panels 5 is mounted on the bottom frame. The plurality of wallboards 6 is mounted on the side frame. The plurality of roof panels 4 is mounted on the top frame. The plurality of upper arcuate wallboards 7 is mounted between the top frame and the side frame. The plurality of lower arcuate wallboards 7 is mounted between the side frame and the bottom frame.

The upper beam 2 is mounted on an end of the top frame of the C-shaped frame 1. The lower beam 3 is mounted on an end of the bottom frame of the C-shaped frame 1.

Figure 2:
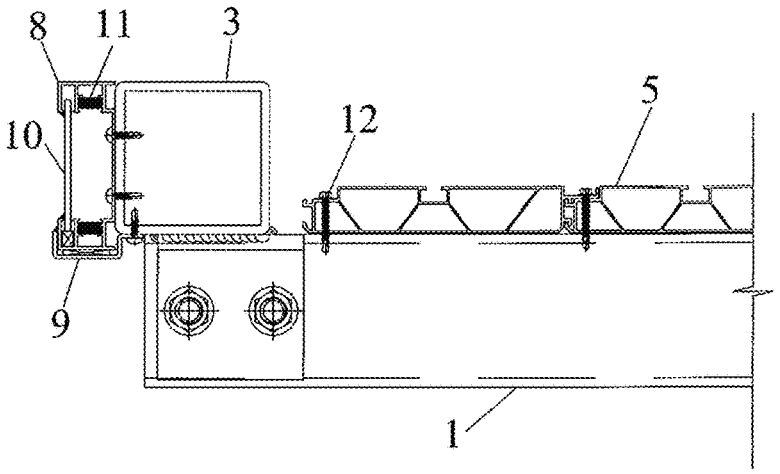
FIG. 2 is an enlarged view of a portion A of the mobile house of FIG. 1.
Figure 6:
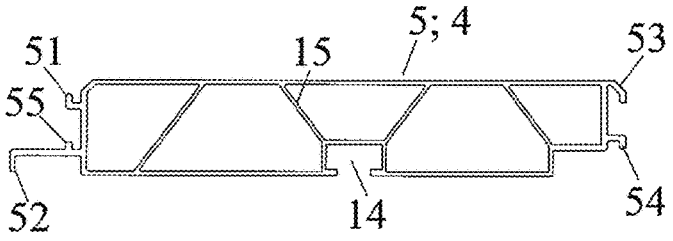
FIG. 6 is a cross sectional view of a roof panel or a floor panel of the mobile house of FIG. 1.

With reference to FIGS. 2 and 6, each of the plurality of floor panels 5 includes an end having an upper, inner buckle 51 and a lower arm inner buckle 52. Each of plurality of floor panels 5 includes another end having an upwardly-inclined outer buckle 53 and a lower, outer buckle 54. Each of the upper, inner buckle 51 and the upwardly-inclined outer buckle 53 of each of the plurality of floor panels 5 has a coupling portion extending outward. The coupling portion of the upper, inner buckle 51 of each of the plurality of floor panels 5 is coupled with the coupling portion of the upwardly-inclined outer buckle 53 of an adjacent floor panel 5. The lower arm inner buckle 52 of each of the plurality of floor panels 5 includes a lower arm having an inner ridge 55 coupled with the lower, outer buckle 54 of the adjacent floor panel 5. The lower arm of the lower arm inner buckle 52 of each of the plurality of floor panels 5 is fixed to an end ledge of the adjacent floor panel 5 by a respective one of the plurality of fasteners 12.

Figure 5:
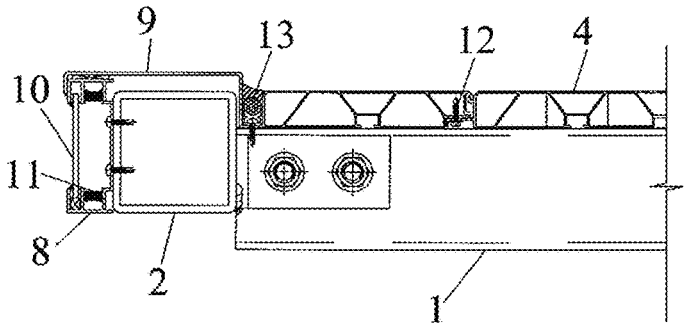
FIG. 5 is an enlarged view of a portion D of the mobile house of FIG. 1.

With reference to FIG. 6, the structure of each of the plurality of roof panels 4 is identical to the structure of each of the plurality of floor panels 5. With reference to FIGS. 5 and 6, each of the plurality of roof panels 4 includes an end having an upper, inner buckle 51 and a lower arm inner buckle 52. Each of plurality of roof panels 4 includes another end having an upwardly-inclined outer buckle 53 and a lower, outer buckle 54. Each of the upper, inner buckle 51 and the upwardly-inclined outer buckle 53 of each of the plurality of roof panels 4 has a coupling portion extending outward. The coupling portion of the upper, inner buckle 51 of each of the plurality of roof panels 4 is coupled with the coupling portion of the upwardly-inclined outer buckle 53 of an adjacent roof panel 4. The lower arm inner buckle 52 of each of the plurality of roof panels 4 includes a lower arm having an inner ridge 55 coupled with the lower, outer buckle 54 of the adjacent roof panel 4. The lower arm of the lower arm inner buckle 52 of each of the plurality of roof panels 4 is fixed to an end ledge of the adjacent roof panel 4 by a respective one of the plurality of fasteners 12.

Figure 7:
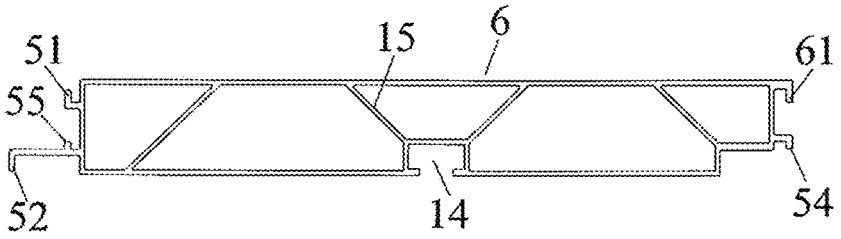
FIG. 7 is a cross sectional view of a wallboard of the mobile house of FIG. 1.

With reference to FIGS. 1 and 7, each of the plurality of wallboards 6 includes an end having an upper, inner buckle 51 and a lower arm inner buckle 52. Each of the plurality of wallboards 6 further includes another end having an upper, outer buckle 61 and a lower, outer buckle 54. Each of the upper, inner buckle 51 and the upper, outer buckle 61 of each of the plurality of wallboards 6 has a coupling portion extending outward. The coupling portion of the upper, inner buckle 51 of each of the plurality of wallboards 6 is coupled with the coupling portion of the upper, outer buckle 61 of an adjacent wallboard 6. The lower arm inner buckle 52 of each of the plurality of wallboards 6 includes a lower arm having an inner ridge 55 coupled with the lower, outer buckle 54 of the adjacent wallboard 6. The lower arm of the lower arm inner buckle 52 of each of the plurality of wallboards 6 is fixed to an end ledge of the adjacent wallboard 6 by a respective one of the plurality of fasteners 12.

Figure 3:
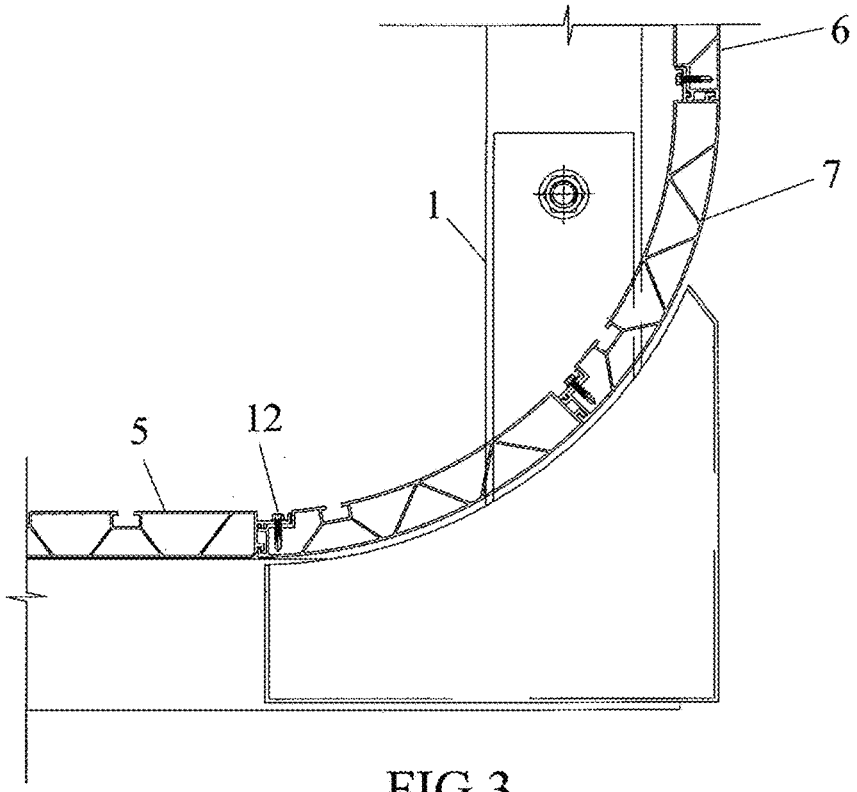
FIG. 3 is an enlarged view of a portion B of the mobile house of FIG. 1.
Figure 4:
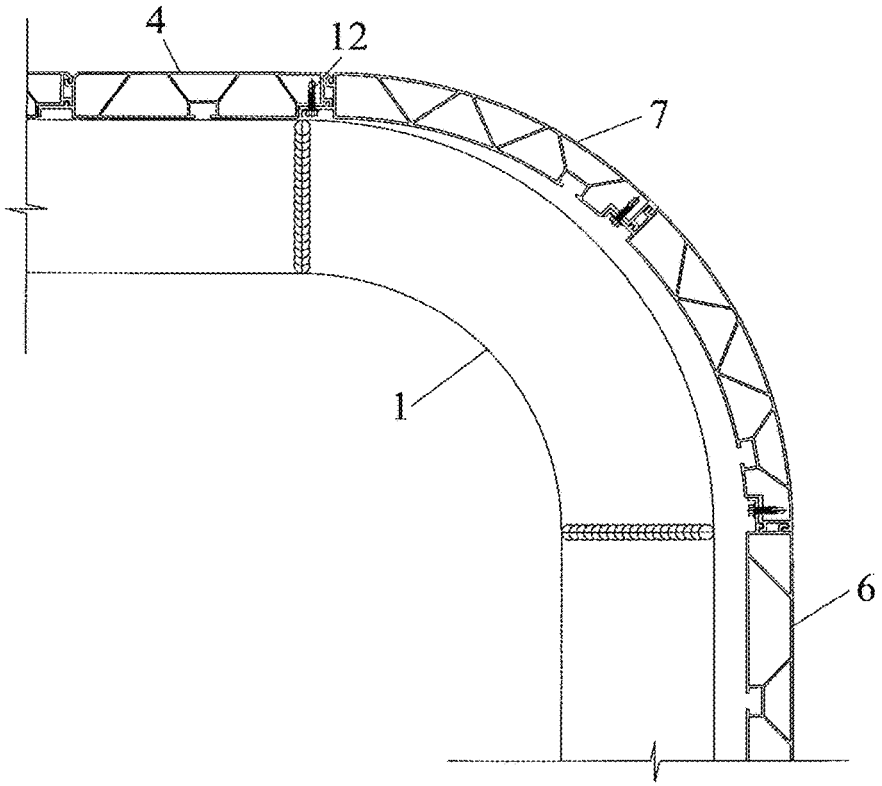
FIG. 4 is an enlarged view of a portion C of the mobile house of FIG. 1.
Figure 8:
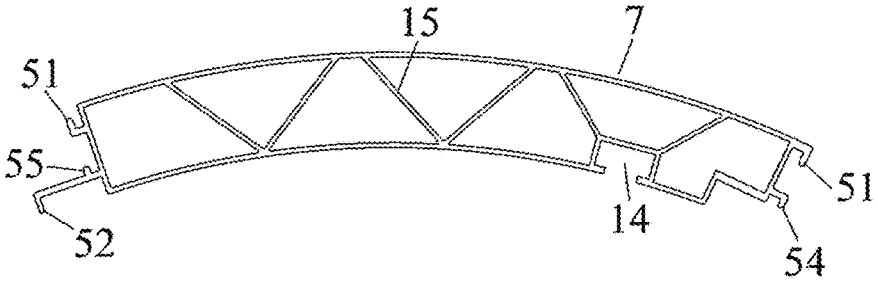
FIG. 8 is a cross sectional view of an arcuate wallboard of the mobile house of FIG. 1.

With reference to FIGS. 3, 4, and 8, each of the plurality of upper and lower arcuate wallboards 7 has an arcuate inner face and an arcuate outer face. Each of the plurality of upper and lower arcuate wallboards 7 includes an end having an upper, inner buckle 51 and a lower arm inner buckle 52. Each of the plurality of upper and lower wallboards 7 further includes another end having an upper, outer buckle 61 and a lower, outer buckle 54. Each of the upper, inner buckle 51 and the upper, outer buckle 61 of each of the plurality of upper and lower arcuate wallboards 7 has a coupling portion extending outward. Two adjacent upper arcuate wallboards 7 are coupled with each other by the coupling portion of the upper, inner buckle 51 of one of the two adjacent upper arcuate wallboards 7 and the coupling portion of the upper, outer buckle 61 of another of the two adjacent upper arcuate wallboards 7. Likewise, two adjacent lower arcuate wallboards 7 are coupled with each other by the coupling portion of the upper, inner buckle 51 of one of the two adjacent lower arcuate wallboards 7 and the coupling portion of the upper outer buckle 61 of another of the two adjacent lower arcuate wallboards 7.

The end or the another end of an innermost one of the plurality of floor panels 5 mounted to the lower frame of the C-shaped frame 1 is coupled with the lowest one of the plurality of lower arcuate wallboards 7. The end or the another end of the lowest one of the plurality of wallboards 6 is coupled with the uppermost one of the plurality of lower arcuate wallboards 7. The plurality of wallboards 6 is mounted between the plurality of upper arcuate wallboards 7 and the plurality of lower arcuate wallboards 7. The end or the another end of the uppermost one of the plurality of wallboards 6 is coupled with the lowest one of the plurality of upper arcuate wallboards 7. The end or the another end of the innermost one of the plurality of roof panels 4 mounted to the upper frame of the C-shaped frame 1 is coupled with the uppermost one of the plurality of upper arcuate wallboards 7. The C-shaped frame 1 is, thus, constructed.

Figure 9:
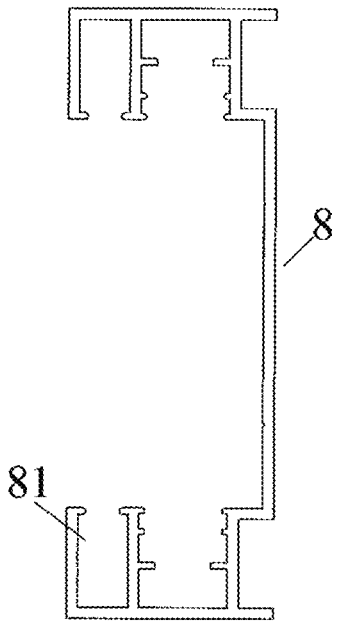
FIG. 9 is a cross sectional view of a lamp groove of the mobile house of FIG. 1.
Figure 10:
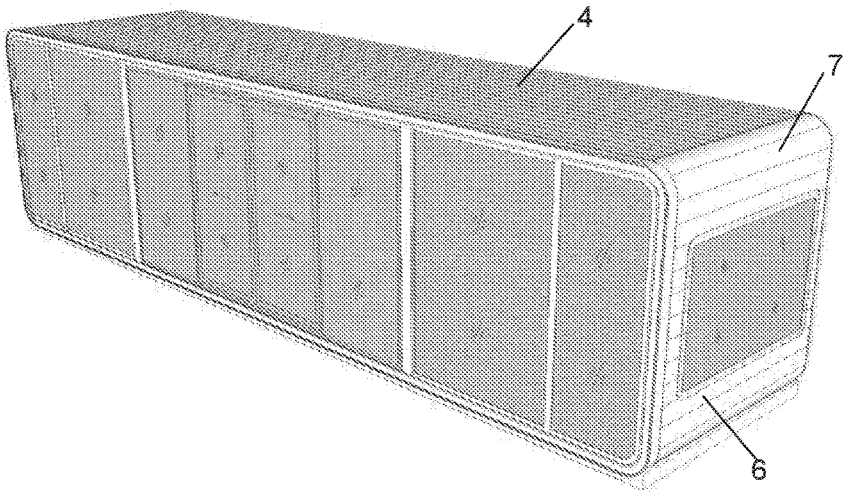
FIG. 10 is a diagrammatic perspective view of the mobile house according to the present invention.

With reference to FIGS. 1, 2, and 9, a lamp groove 8 is mounted in an outer end of the lower beam 3 mounted to the end of the bottom frame of the C-shaped frame 1 and includes an upper section and a lower section. Each of the upper section and the lower section of the lamp groove 8 in the lower beam 3 receives a lamp string 11. A waterproof board 9 is mounted to a bottom of the lamp groove 8 in the lower beam 3. The lamp groove 8 in the lower beam 3 further includes an outer section 81. A light-permeable decorative panel 10 is mounted in the outer section 81 of the lamp groove 8 in the lower beam 3. The lamp strings 11 and the light-permeable decorative panel 10 make the whole structure more aesthetic, such that the whole structure of the house can be exhibited no matter it is daytime or nighttime.

With reference to FIGS. 1, 5, and 9, a lamp groove S is mounted in an outer end of the upper beam 2 mounted to the end of the top frame of the C-shaped frame 1 and includes an upper section and a lower section. Each of the upper section and the lower section of the lamp groove 8 in the upper beam 2 receives a lamp string 11. A waterproof board 9 is mounted to a top of the lamp groove 8 in the upper beam 2. A waterproof sealing material 13 is mounted between the upper beam 2, the waterproof board 9, and the end of the top frame of the C-shape frame 1 to prevent rainwater from entering the interior of the components. The lamp groove 8 in the upper beam 2 further includes an outer section 81. A light-permeable decorative panel 10 is mounted in the outer section 81 of the lamp groove 8.

With reference to FIGS. 2-7, each of the plurality of floor panels 5, the plurality of roof panels 4, the plurality of wallboards 6, the plurality of upper arcuate wallboards 7, and the plurality of lower arcuate wallboards 7 includes an inner face having a C-shaped groove 14 configured to receive a bolt. The function of the C-shaped groove 14 is to fulfill the fixing demand of indoor decoration, avoiding the strengths and the insulating properties of the plurality of floor panels 5, the plurality of roof panels 4, the plurality of wallboards 6, the plurality of upper arcuate wallboards 7, and the plurality of lower arcuate wallboards 7 from being adversely affected by the fixing of the decoration. For example, T-head bolts or hexagonal bolts can be received in the C-shaped grooves 14 and can be slid to the desired locations. Aluminum molds and supporting hinges are coupled by bolts to connecting members and are then tightened by nuts.

Each of the plurality of floor panels 5, the plurality of roof panels 4, the plurality of wallboards 6, the plurality of upper arcuate wallboards 7, and the plurality of lower arcuate wallboards 7 includes a plurality of is reinforcing ribs 15 therein. Each of the plurality of fasteners 12 can be a screw or a pin.

The mobile house of an aluminum alloy structure (such as an ALPOD type mobile house) can be installed as follows:

1. Connect a desired number of C-shaped frames 1 by the upper and lower beams 2 and 3, forming a structural frame of the mobile house.
2. Install and connect the aluminum alloy floor panels 5, the aluminum alloy wallboards 6, the aluminum alloy roof panels 4, and the aluminum alloy upper and lower arcuate wallboards 7. Fix the components by aluminum alloy angle bars, screws, and the C-shaped frames.
3. Install doors and windows of the desired specifications.
4. Proceed with indoor decoration.
5. Inspect the mobile house pursuant to the design.
6. Clean the mobile house and finish manufacturing and installation of the mobile house.

The mobile house of an aluminum alloy structure according to the present invention includes the following features:

1. The Unique Structures of the Wallboards 6, the Roof Panels 4, the Floor Panels 5, and the Upper and Lower Arcuate Wallboards 7.

Since each component has a unique cross section and a unique connecting design, the whole structure is enhanced in the bending strength, the torsional strength, the impact resistance, and, thus, is more resistant to wind and is less likely to deform, and the overall structure is stable. Compared with the conventional design, the overall structure of the present invention can reduce the number of lower crossbeams, columns, and ring beams or even does not have to use these members.

In the indoor decoration of the particular C-shaped groove design, the fasteners 12 are directly used to connect the wallboards 6 and the roof panels 4 without damaging the wallboards 6, the roof panels 4, and the floor panels 5 and without compromising the thermal insulating properties of the wallboards 6 and the roof panels 4.

2. Excellent Waterproof Property.

Since the surfaces of aluminum alloy extrusions are very smooth and flat and since the components are processed and produced in the factory to assure the flatness and tightness at the connections, screws or bolts can be used to connect and tighten after coupling between two boards or panels, achieving seamless connection between boards or panels. This prevents leakage of rainwater resulting from large seams, thereby providing a better waterproof effect.

3. Aesthetic and Fashion Appearance.

Provision of the lamp grooves 8 and the light-permeable decorative panel 10 and placing the lamp strings 11 in the lamp grooves 8 make the whole structure more aesthetic and can exhibit the whole structure no matter it is daytime or night time.

4. Easy Installation.

The wallboards 6 and the roof panels 4 made of aluminum alloy extrusions can be more easily connected with corner connecting members to avoid difficulties in processing and quality guarantee resulting from welding or the like.

5. Modularized Production.

Modules of different patterns can be constructed according to the size of the mobile house and disposition of the doors and windows. After processing and pre-installation in the factory, the modules are transported to the site for module type installation.

6. Transportation of the Whole Assembly.

The whole assembly can be manufactured in the factory according to the specifications regulated by the national road transportation regulations and then transported to the desired location.

7. Low Use Costs.

The surfaces of the aluminum alloy extrusions of the wallboards 6, the roof panels 4, the floor panels 5, and the upper and lower arcuate wallboards 7 have been treated by anode oxidation to provide rigid protective layers on the surfaces of the whole house, which increases the resistance to corrosion, increases the abrasion resistance and hardness, protects the metal surfaces, and significantly reduces future maintenance costs of the hose.

8. Eco-Friendly Low Carbon Emission

The production and installation techniques of the wallboards 6, the upper and lower arcuate wallboards 7, the roof panels 4, and the floor panels 5 made of aluminum alloy extrusions are energy-saving and eco-friendly. Processing of all of the wallboards 6, the upper and lower arcuate wallboards 7, the roof panels 4 and the floor panels 5 can be finished in the factory without second trimming or cutting or re-drilling at the site, avoiding corresponding waste material and cutting noise. The site is free of trashes, and the processing environment is safe, clean, and tidy.

The aluminum alloy raw building material can be renewed to produce aluminum alloy material. Thus, after the mobile house is scrapped and detached, recycling and re-melting can be proceed, and the recovery value can be higher than 80% of the raw material price, which meets the national regulations of buildings in energy saving, environmental protection, low carbon emission, and reduction of carbon emission.

In view of the foregoing, a mobile house of an aluminum alloy structure according to the present invention is produced from aluminum alloy extrusions through precision manufacturing. The aluminum alloy wall boards, aluminum alloy roof panels, aluminum alloy floor panels, and aluminum alloy arcuate wallboards are connected to each other and assembled plus fixing by nails or screws to provide a reliable, safe connection for the components, assuring that the whole structure is enhanced in the bending strength, the torsional strength, the impact resistance, the impermeability to water, and the overall stability. Thus, the spatial utility of the house is increased, and the appearance of the house is more aesthetic.

Although specific embodiments have been illustrated and described, numerous modifications and variations are still possible without departing from the scope of the invention. The scope of the invention is limited by the accompanying claims.

The invention claimed is:

1. A mobile house of an aluminum alloy structure comprising a plurality of components made of an aluminum alloy, wherein the plurality of components includes a C-shaped frame, an upper beam, a lower beam, a plurality of roof panels, a plurality of floor panels, a plurality of wallboards, a plurality of upper arcuate wallboards, and a plurality of lower arcuate wallboards, wherein the plurality of components is connected by a plurality of fasteners, wherein the C-shaped frame includes a bottom frame, a side frame, and a top frame, wherein the plurality of floor panels is mounted on the bottom frame, wherein the plurality of wallboards is mounted on the side frame, wherein the plurality of roof panels is mounted on the top frame, wherein the plurality of upper arcuate wallboards is mounted between the top frame and the side frame, wherein the plurality of lower arcuate wallboards is mounted between the side frame and the bottom frame, wherein the upper beam is mounted on an end of the top frame of the C-shaped frame, wherein the lower beam is mounted on an end of the bottom frame of the C-shaped frame, wherein each of the plurality of floor panels includes an end having an upper, inner buckle and a lower arm inner buckle, wherein each of plurality of floor panels includes another end having an upwardly-inclined outer buckle and a lower, outer buckle, wherein each of the upper, inner buckle and the upwardly-inclined outer buckle of each of the plurality of floor panels has a coupling portion extending outward, wherein the coupling portion of the upper, inner buckle of each of the plurality of floor panels is coupled with the coupling portion of the upwardly-inclined outer buckle of an adjacent floor panel, wherein the lower arm inner buckle of each of the plurality of floor panels includes a lower arm having an inner ridge coupled with the lower, outer buckle of the adjacent floor panel, wherein the lower arm of the lower arm inner buckle of each of the plurality of floor panels is fixed to an end ledge of the adjacent floor panel by a respective one of the plurality of fasteners, wherein a structure of each of the plurality of roof panels is identical to a structure of each of the plurality of floor panels, wherein each of the plurality of wallboards includes an end having an upper, inner buckle and a lower arm inner buckle, wherein each of the plurality of wallboards further includes another end having an upper, outer buckle and a lower, outer buckle, wherein each of the upper, inner buckle and the upper, outer buckle of each of the plurality of wallboards has a coupling portion extending outward, wherein the coupling portion of the upper, inner buckle of each of the plurality of wallboards is coupled with the coupling portion of the upper, outer buckle of an adjacent wallboard, wherein the lower arm inner buckle of each of the plurality of wallboards includes a lower arm having an inner ridge coupled with the lower, outer buckle of the adjacent wallboard, wherein the lower arm of the lower arm inner buckle of each of the plurality of wallboards is fixed to an end ledge of the adjacent wallboard by a respective one of the plurality of fasteners, wherein each of the plurality of upper and lower arcuate wallboards has an arcuate inner face and an arcuate outer face, wherein each of the plurality of upper and lower arcuate wallboards includes an end having an upper, inner buckle and a lower arm inner buckle, wherein each of the plurality of upper and lower wallboards further includes another end having an upper, outer buckle and a lower, outer buckle, wherein each of the upper, inner buckle and the upper outer buckle of each of the plurality of upper and lower arcuate wallboards has a coupling portion extending outward, wherein two adjacent upper arcuate wallboards are coupled with each other by the coupling portion of the upper, inner buckle of one of the two adjacent upper arcuate wallboards and the coupling portion of the upper, outer buckle of another of the two adjacent upper arcuate wallboards, wherein two adjacent lower arcuate wallboards are coupled with each other by the coupling portion of the upper, inner buckle of one of the two adjacent lower arcuate wallboards and the coupling portion of the upper, outer buckle of another of the two adjacent lower arcuate wallboards, wherein the end or the another end of an innermost one of the plurality of floor panels mounted to the lower frame of the C-shaped frame is coupled with a lowest one of the plurality of lower arcuate wallboards, wherein the end or the another end of a lowest one of the plurality of wallboards is coupled with an uppermost one of the plurality of lower arcuate wallboards, wherein the end or the another end of an uppermost one of the plurality of wallboards is coupled with a lowest one of the plurality of upper arcuate wallboards, and wherein the end or the another end of an innermost one of the plurality of roof panels mounted to the upper frame of the C-shaped frame is coupled with an uppermost one of the plurality of upper arcuate wallboards.

2. The mobile house of the aluminum alloy structure as claimed in claim 1, wherein a lamp groove is mounted in an outer end of the lower beam mounted to the end of the bottom frame of the C-shaped frame and includes an upper section and a lower section, wherein each of the upper section and the lower section of the lamp groove receives a lamp string, and wherein a waterproof board is mounted to a bottom of the lamp groove.

3. The mobile house of the aluminum alloy structure as claimed in claim 2, wherein the lamp groove further includes an outer section, and wherein a light-permeable decorative panel is mounted in the outer section of the lamp groove.

4. The mobile house of the aluminum alloy structure as claimed in claim 1, wherein a lamp groove is mounted in an outer end of the upper beam mounted to the end of the top frame of the C-shaped frame and includes an upper section and a lower section, wherein each of the upper section and the lower section of the lamp groove receives a lamp string, and wherein a waterproof board is mounted to a top of the lamp groove.

5. The mobile house of the aluminum alloy structure as claimed in claim 4, wherein a waterproof sealing material is mounted between the upper beam, the waterproof board, and the end of the top frame of the C-shape frame.

6. The mobile house of the aluminum alloy structure as claimed in claim 4, wherein the lamp groove further includes an outer section, and wherein a light-permeable decorative panel is mounted in the outer section of the lamp groove.

7. The mobile house of the aluminum alloy structure as claimed in claim 1, wherein each of the plurality of floor panels, the plurality of roof panels, the plurality of wallboards, the plurality of upper arcuate wallboards), and the plurality of lower arcuate wallboards includes an inner face having a C-shaped groove configured to receive a bolt.

8. The mobile house of the aluminum alloy structure as claimed in claim 1, wherein each of the plurality of floor panels, the plurality of roof panels, the plurality of wallboards, the plurality of upper arcuate wallboards, and the plurality of lower arcuate wallboards includes a plurality of reinforcing ribs therein.

9. The mobile house of the aluminum alloy structure as claimed in claim 1, wherein each of the plurality of fasteners is a screw or a pin.

* * * * *